US007726853B2

(12) United States Patent
Li et al.

(10) Patent No.: US 7,726,853 B2
(45) Date of Patent: Jun. 1, 2010

(54) HINGE FOR A LAMP

(75) Inventors: Hao Li, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/177,846

(22) Filed: Jul. 22, 2008

(65) Prior Publication Data

US 2009/0161375 A1 Jun. 25, 2009

(30) Foreign Application Priority Data

Dec. 19, 2007 (CN) ..... 2007 1 0125265

(51) Int. Cl.
*F21S 13/02* (2006.01)

(52) U.S. Cl. ..... 362/457; 362/427; 362/431

(58) Field of Classification Search ..... 362/427, 362/431, 414, 421, 457; 248/416, 425
See application file for complete search history.

(56) References Cited

U.S. PATENT DOCUMENTS 2,434,986 A * 1/1948 Bremer ..... 362/421
4,428,554 A * 1/1984 Hartman ..... 248/415
4,527,225 A * 7/1985 Hartman ..... 362/294
7,458,552 B2 * 12/2008 Matts et al. ..... 248/324

FOREIGN PATENT DOCUMENTS

CN 2677973 Y 2/2005

* cited by examiner

*Primary Examiner*—John A Ward
(74) *Attorney, Agent, or Firm*—Frank R. Niranjan

(57) ABSTRACT

A lamp hinge includes a first connector and a second connector pivotally connecting with the first connector. The first connector defines a circular groove therein. The second connector has a pivotal portion pivotally engaging the first connector, and a mounting portion connecting with a lamp head of the lamp. The pivotal portion defines a curved groove therein. The mounting portion defines a central hole therein. A plurality of ball bearings are movably sandwiched between the pivotal portion and the first connector and received in the circular groove and the curved groove. The ball bearings separate the first connector from the second connector a space. Two neighboring ball bearings define a gap therebetween, for providing passage of the electric wires of the lamp therethrough. The gap communicates with the central hole of the mounting portion of the second connector.

9 Claims, 4 Drawing Sheets

HINGE FOR A LAMP

BACKGROUND OF THE INVENTION

1. Field of the Invention

The present invention relates to fasteners, and more particularly to a hinge connecting a lamp head and a lamp stand of, for example, a table lamp.

2. Description of Related Art

In a variety of conventional lamps, the projecting angle of a lamp is generally adjusted by means of a hinge connecting a lamp head with a lamp stand. Electric wires extend from the lamp stand through the hinge to reach the lamp head.

Referring to FIG. 4, a related lamp hinge (not labeled) comprises a first connector 29 and a second connector 11 pivotably connected to the first connector 29 connecting with a lamp head (not shown). The first connector 29 is integrally formed at a top of a lamp pole 20 which has a bottom end for connecting with a lamp stand (not shown). The second connector 11 can rotate relative to the first connector 29. The lamp pole 20 comprises a pair of shells 21, 22. The second connector 11 comprises a pivotal portion 15 pivotally received in the first connector 29. The pivotal portion 15 evenly forms three protruding portions 17, 18, 19 circumferentially distributed at a side thereof. Each protruding portion 17, 18, 19 has a cylindrical configuration. The protruding portions 17, 18, 19 are pivotally received in a groove 220 of the first connector 29. During assembly of the lamp, electric wires of the lamp extend through a gap between the protruding portions 17, 18 or between the protruding portions 18, 19. As the second connector 11 rotates relative to first connector 29, the electric wires may be abraded by the protruding portion 18 located between the protruding portions 17, 19. Furthermore, because of limited contact area between the protruding portions 17, 18, 19 and the first connector 29, the protruding portions 17, 18, 19 are prone to wear and a lifespan of the hinge of the lamp will be reduced.

There is thus a need to provide a hinge for a lamp which will not abrade the electric wires when the hinge is rotated, preferably with a robust structure to extend product lifetime.

SUMMARY OF THE INVENTION

A lamp hinge includes a first connector and a second connector pivotally connected thereto. The first connector defines a circular groove therein. The second connector has a pivotal portion pivotally engaging the first connector and a mounting portion connecting with a lamp head of the lamp. The pivotal portion defines a curved groove therein. The mounting portion defines a central hole therein. A plurality of ball bearings are movably sandwiched between the pivotal portion of the second connector and the first connector and received in the circular groove and the curved groove. The ball bearings separate the first connector from the second connector to define a space therebetween. A gap is defined between two neighboring ball bearings for providing passage of electric wires of the lamp therethrough. The curved groove is longer than half the perimeter of an annulus in which the curved groove is distributed. The gap communicates with the central hole of the mounting portion of the second connector. Thus, the electric wires are protected from abrasion by the second connector when the second connector rotates relative to the first connector during adjustment of the projecting angle of the lamp head.

BRIEF DESCRIPTION OF THE DRAWINGS

Many aspects of the present hinge can be better understood with reference to the following drawings. The components in the drawings are not necessarily drawn to scale, the emphasis instead being placed upon clearly illustrating the principles of the present hinge. Moreover, in the drawings, like reference numerals designate corresponding parts throughout the several views.

DETAILED DESCRIPTION OF THE INVENTION

Figure 1:
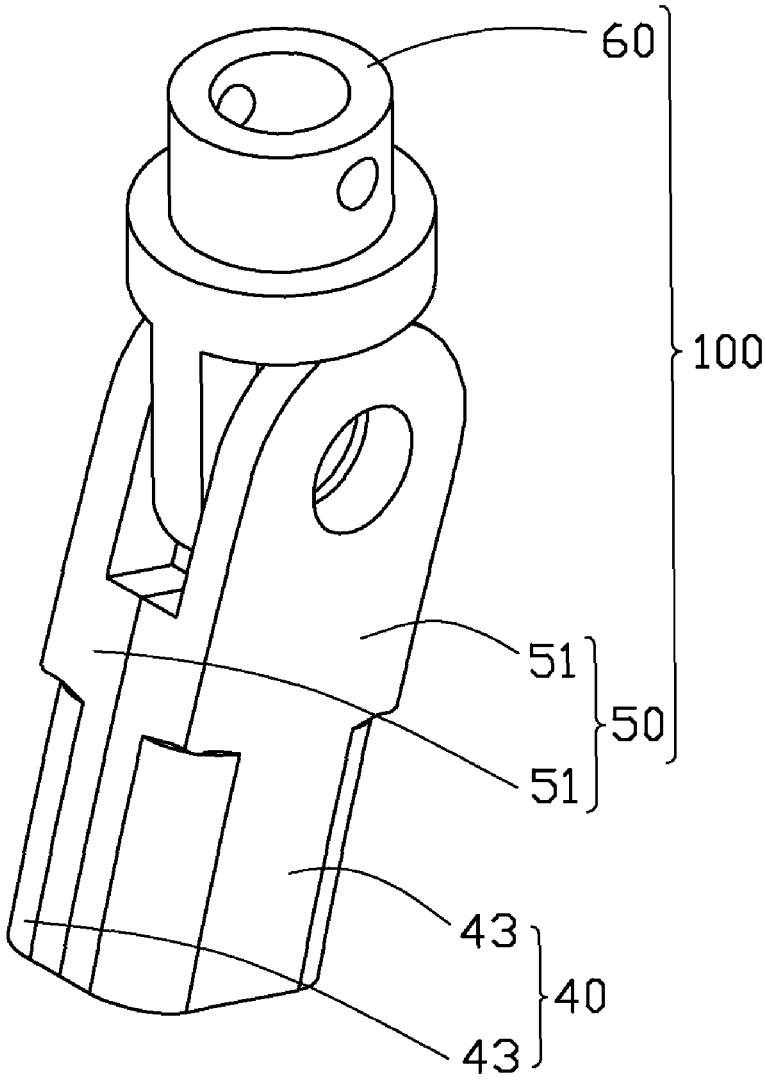
FIG. 1 is an assembled, isometric view of a lamp hinge connecting with a lamp head and a lamp stand in accordance with a preferred embodiment of the present invention.

Referring to FIG. 1, a hinge 100 of an adjustable lamp of a preferred embodiment of the invention is shown. The hinge 100 connects a lamp head (not shown) to a lamp pole 40 and a lamp stand (not shown). The hinge 100 is provided at an upper end of the lamp pole 40. In the present invention the lamp pole 40 is partly cut away. The hinge 100 comprises a first connector 50 and a second connector 60. The first and second connectors 50, 60 form a swivel to rotate the lamp head relative to the lamp pole 40. The first connector 50 can be fastened on the lamp pole 40 or integrally formed with the lamp pole 40. In this embodiment, the first connector 50 is integrally formed with the lamp pole 40. The lamp head is fastened on the second connector 60. Electric wires (not shown) extend through the first and second connectors 50, 60 and the lamp pole 40, electrically connecting the lamp head and the lamp stand. Another first connector (not shown) is formed on a lower end of the lamp pole 40. Another second connector (not shown) is pivotally received in the other first connector (not shown) and connects the lamp pole 40 and the lamp stand.

Figure 2:
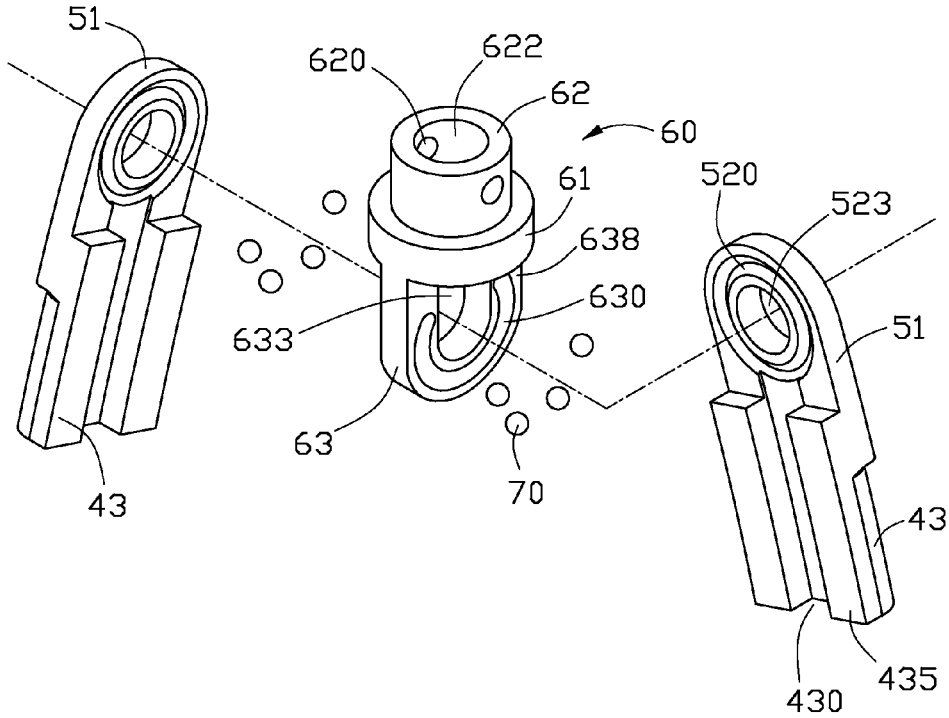
FIG. 2 is an exploded, isometric view of the lamp hinge of FIG. 1.
Figure 3:
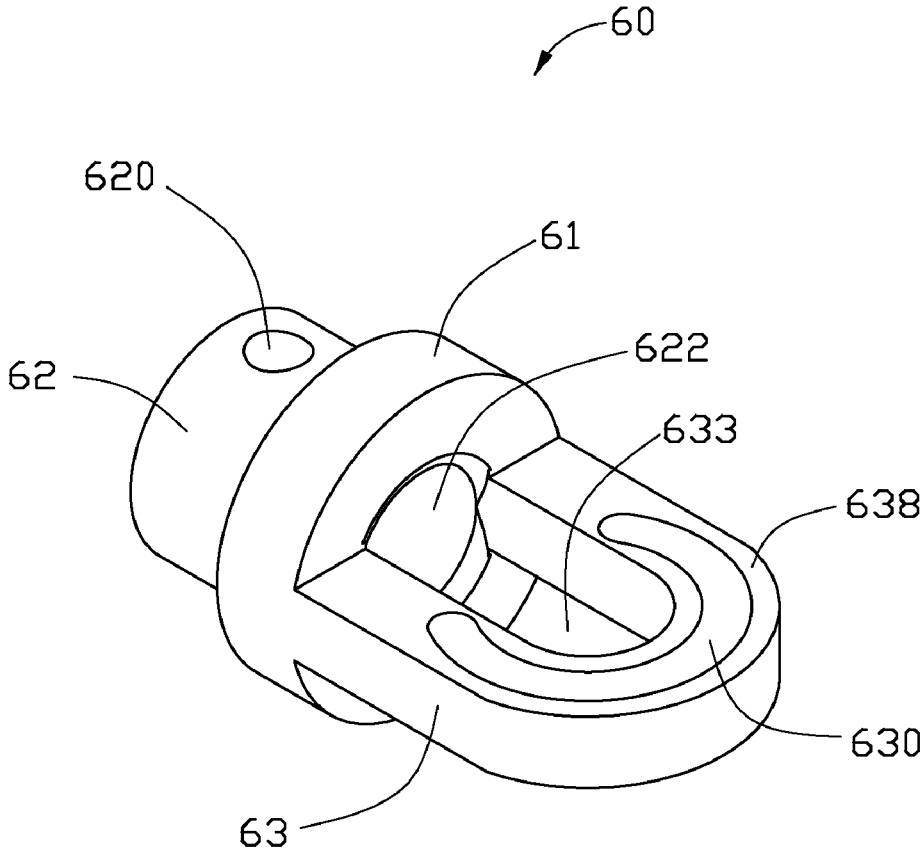
FIG. 3 is an isometric view of a second connector of the lamp hinge of FIG. 2.
Figure 4:
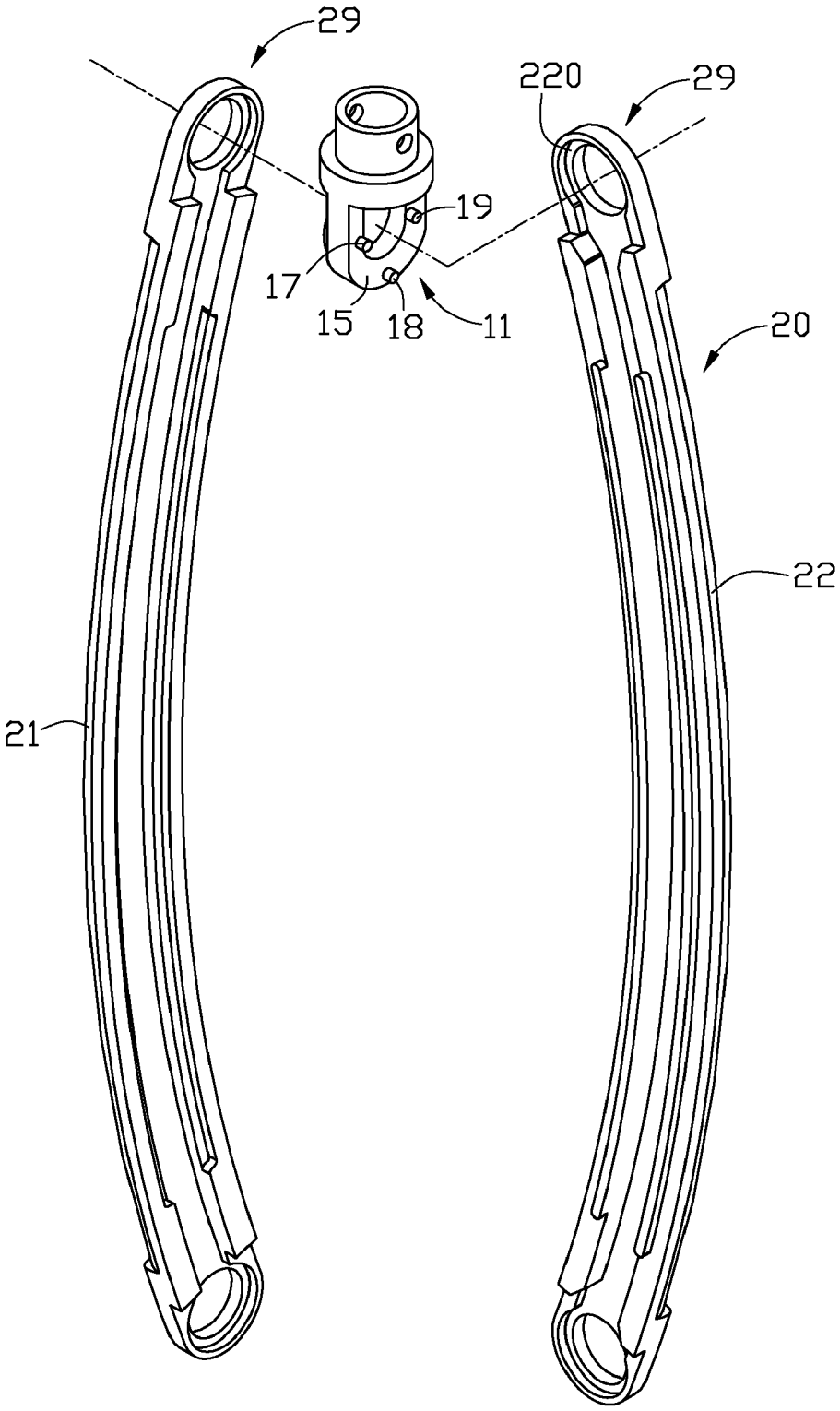
FIG. 4 (RELATED ART)
FIG. 4 is an isometric view of a related lamp hinge.

Referring to FIGS. 2-3, the lamp pole 40 comprises a pair of shells 43. The shells 43 contact each other to define an elongated space therebetween into which the electric wires extend. Each shell 43 has two contacting portions 435 protruding from two lateral edges on an inner side thereof and an elongated recessed portion 430 between the contacting portions 435. The recessed portions 430 together define the elongated space communicating with the circular groove 520 of the engaging part 51.

The first connector 50 comprises a pair of engaging parts 51 formed at an upper end of the shells 43 of the lamp pole 40 and sandwiching the second connector 60 therebetween. Each engaging part 51 connects with each shell 43 of the lamp pole 40, respectively. Each engaging part 51 has a circular profile and transversely defines an axle hole 523 therein. A circular groove 520 is defined at an inner side face of the engaging part 51. The groove 520 surrounds the axle hole 523.

The second connector 60 pivotally engages the engaging parts 51 of the first connector 50. The second connector 60 comprises a main body 61, a mounting portion 62 extending upwardly from a top of the main body 61, and a pivotal portion 63 extending downwardly from the main body 61.

The mounting portion 62 and the main body 61 are annular and share a common axis. A central hole 622 is defined through the mounting portion 62 and the main body 61. The mounting portion 62 has two mounting holes 620 for extension of a fastener (not shown) therethrough to secure the lamp head to the second connector 60. The pivotal portion 63 has a U-shaped configuration with two ends connecting with the main body 61. The pivotal portion 63 has two parallel U-shaped side faces 638. The pivotal portion 63 defines a through hole 633 through the side faces 638. The through hole 633 communicates perpendicularly with the central hole 622 of the mounting portion 62 and the main body 61. Each of the side faces 638 of the pivotal portion 63 defines a curved groove 630 thereon. An annulus where the curved groove is distributed has the same inner diameter as that of the circular groove 520 of the engaging part 51 of the first connector 50. Each curved groove 630 is longer than half the perimeter of the annulus in which the curved groove 630 is distributed. In this embodiment, a curved length of each curved groove 630 is three quarters of the perimeter of the annulus.

During assembly of the hinge 100, the pivotal portion 63 of the second connector 60 is sandwiched between the engaging parts 51 of the first connector 50. The contacting portions 435 of one shell 43 of the lamp pole 40 contact the contacting portions 435 of the other shell 43. A plurality of ball bearings 70 is sandwiched between the second connector 60 and each first connector 50; in this embodiment, the number of the ball bearings 70 is four. The ball bearings 70 roll in the curved groove 630 of the second connector 60 and the circular groove 520 of the engaging part 51 of the first connector 50. Each ball bearing 70 contacts an inner surface of the curved groove 630 of the second connector 60 and the inner surface of the circular groove 520 of each first connector 50. Thus, the pivotal portion 63 of the second connector 60 can rotate relative to the engaging parts 51 of the first connector 50 by a roll of the ball bearings 70. An outer diameter of each ball bearing 70 is larger than a summation of a deepness of the curved groove 630 of the second connector 60 and a deepness of the circular groove 520 of the first connector 50. Thus, the engaging parts 51 of the first connector 50 and the side faces 638 the pivotal portions 63 of the second connector 60 are spaced by the ball bearings 70, and gaps are defined between two neighboring ones of the ball bearings 70. A retainer (not shown) such as a shaft can be inserted into the axle holes 523 of the first connector 50 and the through hole 633 of the second connector 60. The retainer secures the first and second connectors 50, 60 and permits the second connector 60 to rotate relative to the first connector 50.

After assembly of the hinge 100, the second connector 60 rotates relative to the first connector 50 to adjust the projecting angle of the lamp head which connects with the second connector 60. The ball bearings 70 roll in the curved groove 630 of the second connector 60 and the circular groove 520 of the engaging part 51 of the first connector 50. The gap communicates with the central hole 622 of the mounting portion 62 of the second connector 60 and recessed portion 430 of the lamp pole 40. The electric wires extend through the first and second connectors 50, 60 from the lamp pole 40 to the lamp head by extending through the recessed portion 430 of the lamp pole 40, the gap between the ball bearings 70, the through hole 633 of the pivotal portion 63 and the central hole 622 in sequence. When the second connector 60 rotates relative to the first connector 50, the electric wires are not unduly driven by rolling ball bearings to move therewith. As a result, the abrasion of the electric wires by the pivotal portion 63 of the second connector 60 and the engaging parts 51 of the first connector 50 is avoided; as is commensurate damage to the electric wires due to the pivoting movement of the hinge 100 can be avoided.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A hinge for a lamp comprising:

a first connector on an upper end of a lamp pole, defining a circular groove therein;

a second connector having a pivotal portion pivotally engaging the first connector and a mounting portion adapted for connecting with a lamp head of the lamp, the pivotal portion defining a curved groove therein, the curved groove being longer than a half of a perimeter of an annulus where the curved groove is distributed, the mounting portion defining a central hole therein; and a plurality of ball bearings movably sandwiched between the pivotal portion of the second connector and the first connector and received in the circular groove and the curved groove, the ball bearings separating the first connector from the second connector to define a space therebetween, a gap being defined between two neighboring ones of the ball bearings, the gap providing passage adapted for electric wires of the lamp to extend therethrough, the gap communicating with the central hole of the mounting portion of the second connector;

wherein the second connector comprises a U-shaped pivotal portion extending from the mounting portion, with the curved groove defined at a side face of the pivotal portion.

2. The hinge as described in claim 1, wherein the curved groove of the second connector has a curved length accounting for three quarters of the perimeter of the annulus.

3. The hinge as described in claim 1, wherein an outer diameter of each ball bearing is larger than a sum of a deepness of the curved groove of the second connector and a deepness of the circular groove of the first connector.

4. The hinge as described in claim 1, wherein the pivotal portion defines a through hole, the gap communicating with the through hole of the pivotal portion and the central hole of mounting portion, the through hole being oriented perpendicular to the central hole.

5. The hinge as described in claim 1, wherein the first connector comprises a pair of engaging parts, the engaging parts sandwiching the pivotal portion of the second connector therebetween.

6. The hinge as described in claim 5, wherein the circular groove is defined at an inner side of each of the engaging parts corresponding to the curved groove of the second connector.

7. The hinge as described in claim 6, wherein the engaging parts each define an axle hole adapted for accommodating a retainer securing the first and second connectors together.

8. The hinge as described in claim 7, wherein the circular groove surrounds the axle hole of the engaging part.

9. The hinge as described in claim 1, wherein a number of the ball bearings is four.

* * * * *